United States Patent [19]

Nishioka

[11] 3,990,976

[45] Nov. 9, 1976

[54] CYCLONE WITH PLURAL PERIPHERAL DISCHARGE TUBES

[76] Inventor: Yasuhito Nishioka, 1-23, Ikagahonmachi, Hirakata, Osaka, Japan

[22] Filed: Feb. 3, 1975

[21] Appl. No.: 546,341

[30] Foreign Application Priority Data

Mar. 20, 1974 Japan ..... 49-32288

[52] U.S. Cl. ..... 210/512 R; 55/452; 55/459 R; 209/144; 209/211; 210/512 M

[51] Int. Cl.[2] ..... F01D 21/26; F01D 33/02

[58] Field of Search ..... 210/512 R, 512 M; 209/144, 211; 55/204, 338, 392, 395, 459 R, 177, 459 A–459 D

[56] References Cited

UNITED STATES PATENTS

| | | | |
|---|---|---|---|
| 2,432,317 | 12/1947 | Lawson et al. | 210/512 R |
| 2,724,503 | 11/1955 | Fontein | 209/211 |
| 2,726,767 | 12/1955 | Rakowsky | 210/512 R |
| 2,769,546 | 11/1956 | Fontein | 210/512 R |
| 2,804,206 | 8/1957 | Turpin | 209/211 |
| 2,963,154 | 12/1960 | Vane | 209/211 |
| 2,965,232 | 12/1960 | Vane | 209/211 |
| 2,967,618 | 1/1961 | Vane | 210/512 R |
| 3,764,005 | 10/1973 | Zemanek | 210/512 R |

*Primary Examiner*—Frank W. Lutter
*Assistant Examiner*—Frank Sever
*Attorney, Agent, or Firm*—George B. Oujevolk

[57] ABSTRACT

In a cyclone separator of improved construction, a plurality of axially aligned solids collection tubes are positioned on the outermost periphery of the main body of the separator, to conduct solids, separated from the initial feed, from the main body to a container positioned beneath the tubes and main body.

1 Claim, 4 Drawing Figures

CYCLONE WITH PLURAL PERIPHERAL DISCHARGE TUBES

This invention relates to a cyclone collector and in particular a cyclone collector characteristically improved in separating solids either from gases or from liquids.

A conventional device of this kind is so mechanized as to allow solids-containing fluid to flow tangentially against a drum thereof or afford a cyclonic movement thereto with the use of a guide blade thereby causing a centrifugal force to effectuate on the quickening of precipitation of said solids within said drum thereby enabling to collect said solids from the drum at an end portion thereof.

Such a conventional cyclone collector as above is defective, however, in that the precipitating speed is lowered due to the contradictory cyclonic pressure against said solids inevitably caused through the cyclonic flowing of said fluid within said drum, the solids separating effect being lowered as a matter of natural result.

This invention provides a cyclonic collector having a high efficiency for that purpose, characteristically disposing one or more than one precipitation promoting tubes of a small diameter outside the drum so as to make them communicate with said drum through as many openings provided thereon.

A first object of this invention is to provide a cyclone collector capable of efficiently separating solids from within fluid, either gases or liquids.

A second object of this invention is to provide a cyclone collector capable of adjusting pressure inside the cyclone drum relatively to that of the precipitating tubes by means of operating a damper mounted in said precipitating tubes thereby becoming free from reverse flowing of separated solids back to the drum.

A third object of this invention is to provide a cyclone collector enabling to prevent accidental outflow of liquids from the drum before completion of solids isolation therefrom.

In order that this invention may be readily understood, reference is made hereinunder to the annexed drawing which illustrates preferred embodiments of this invention:

Figure 1:
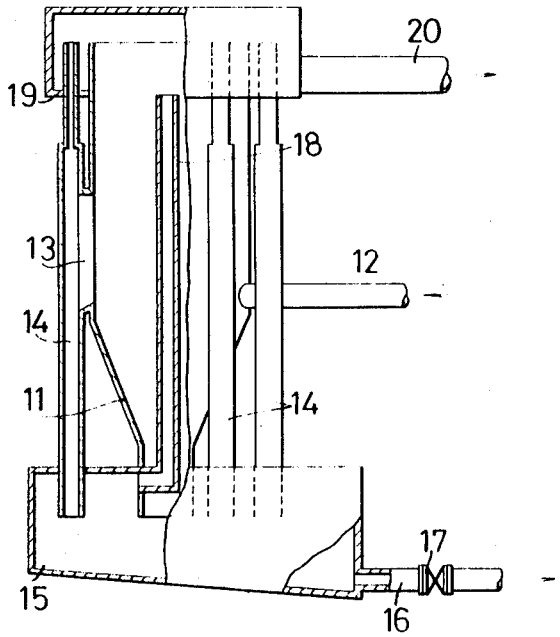
FIG. 1 is a partially-broken front view of a cyclone collector of this invention in the first embodiment.
Figure 2:
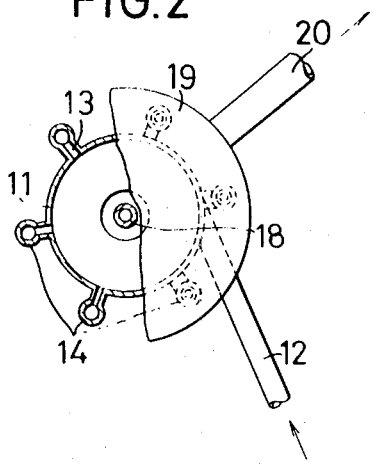
FIG. 2 is a partially broken plan view of the above.

Shown in FIGS. 1 and 2 is a cyclone collector suitable especially for isolating flock-like solids. Numeral 11 designating a cyclone collector drum which is divided intermediately in a cylindrical form and a conical form at the upper and lower portion thereof respectively, said lower portion being minimized diametrically at the lower end thereof. Numeral 12 designates an injection pipe provided so as to communicate with said drum 11 intermediately at the outer periphery thereof, said pipe 12 enabling to tangentially jet in fluid containing flock-like solids.

The peripheral wall of said drum 11 at an intermediate portion of said cyclindrical portion is disposed with one or more than one vertically slit-formed openings 13 keeping a predetermined space between each other in the cyclic direction.

At the outer periphery of said drum 11 outside each opening 13 is vertically disposed a precipitating tube 14, each tube 14 at an intermediate inside portion thereof communicating with said cyclone drum 11 through said opening 13.

The drum 11 at the lower portion thereof is provided with a reservoir 15 for storing isolated solids in the state that said reservoir 15 communciates with the lower end opening of said drum 11, said reservoir 15 at the lowermost portion thereof being provided with a pipe 16 for discharging said isolated solids, also said discharging pipe 16 incorporating a discharging valve 17. Said precipitating tube 14 at its open lower edge communicates with the inside of said reservoir 15.

The drum 11 incorporates a flowing pipe 18 in the state that the opening of said pipe 18 at its upper end is positioned below the lower edge of said drum 11, said flowing pipe 18 at its lower end bending perpendicularly thereby extending through the peripheral wall of the drum 11 at its lower end, said flowing pipe 18 at its lower end opening communicating with the inside of said reservoir 15.

This pipe 18 plays the role of removing infiltrated liquid from inside the reservoir 15 toward the upper portion of said drum 11 thereby reducing the resistance of said liquid against the precipitating solids and accordingly enabling to prompt the sedimentation and concentration thereof.

Also, at the upper end outer periphery of said drum 11 is mounted a cyclic groove 19 for receiving fluid as it flows out through the upper edge opening of said drum 11, said groove 19 connecting to a pipe 20 for the exhaustion of treated fluid.

The fore-mentioned precipitator 14 at its open upper end abuts on the upper portion of said groove 19 thereby enabling upstreaming fluid within said tube 14 to be discharged out of said groove 19.

The cyclone collector of this invention in the first embodiment constituted as foregoing is put into practical use as following.

When water containing solids in the form of rough flocks and the like is jetted continuously through the injection pipe 12 into the drum 11, it will result in a cyclonical flowing of said liquid under the guide of the inside peripheral wall of said drum 11. Due to said cyclonical movement, solids of bigger gravity receive bigger centrifugal force thereby moving outerward from the center of said drum 11 simultaneously precipitating spirally along the inside peripheral wall thereof.

The solids of bigger gravity and size tend to move farther from the center outwardly under the bigger centrifugal force thereby coming closer to the opening portion of said drum 11, said solids thence advancing into the precipitating tube 14 filled with untreated fluid. The solids entering in said tube 14 receives no more effect from the cyclonic movement of said fluid in the drum 11 simultaneously dwindling their moving scale within said tube 14, said solids thereby rapidly losing their moving energy through their mutually colliding movement resulting in their quickened sedimentation within said precipitation tube 14, the isolated solids thence dropping into said reservoir 15.

Solids of smaller gravity and size which failed to reach said opening 13 in the drum 11 fall along the lower peripheral wall of the cone form lower portion of said drum 11 thereby precipitating in the reservoir 15 through the lower end opening of said drum 11.

Also, when the solids precipitate in the reservoir 15, inflitrated water within said reservoir 15 flows out by a volume proportionate to the cubic capacity of said solids through said flowing pipe 18 into the upper portion of said drum 11 thereby enabling to quicken the precipitation and concentration of said solids in the precipitating tube 14 and also the drum 11.

The solids-separated water flows over the upper peripheral edge of said drum 11 into said cyclic groove 19 thence through the exhaustion pipe 20 to be discharged to a predetermined spot, simultaneously in said precipitating tube 14 said treated water flows out through its upper edge into said groove 19.

Also, for the concentrated solids not to flow out in the state of mixing in the treated water, the supply of untreated water may be adjusted in amount proportionately to the precipitating speed of the solids simultaneously solids staying hours within said drum 11 may be controlled, the concentrated solids within said reservoir 15 being fed to dewatering machine and the like through the discharging pipe 16 by means of opening said discharging valve 17.

Figure 3:
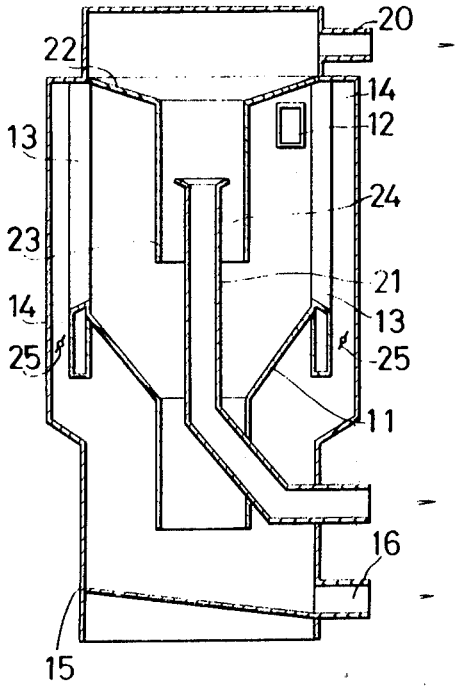
FIG. 3 is a longitudinal section of a cyclone collector in the second embodiment.

The second embodiment of this invention as shown in FIG. 3 will be illustrated hereinunder wherein components equivalent in construction and functions with those in the first embodiment will be designated by same numerals without repeating descriptions thereof.

The cyclone collector drum 11 as in case of the first embodiment is provided at the upper portion thereof with an injection pipe 12, said drum 11 further incorporating an exhaustion pipe 21, said pipe 21 at its lower end extending through the peripheral wall of a reservoir 15 in a watertight state, at its intermediate portion extending through the lower portion peripheral wall of said drum 11, and at its upper end portion above said intermediate portion extending axially upwardly within said drum 11.

The exhaustion pipe 21 at the upper end opening thereof is so positioned as to abut on a spot at a predetermined height at the upper portion inside of said drum 11 so that the exhaustion of treated water may be properly processed, said pipe 21 also at its upper terminal spanning upwardly and outwardly.

The drum 11 at its upper portion is formed with a centerward-tapering top wall 22 in a stretched state, said top wall 22 at a position below the central opening thereof is mounted with a cylindrical member 23 which covers at its lower terminal the upper outer periphery of said exhaustion pipe 21. The cylindrical member 23 covers the pipe 21 from its upper end through its lower portion at an intermediate point thereof. In between said cylindrical member 23 and said pipe 21 is formed a passage 24 for the flowing of treated water therethrough. Also, overflowing treated water is discharged through a discharging pipe 20 provided at a position upper than the top wall 22.

The precipitating tube 14 disposed around the drum 11 is closed at its upper end and incorporates a damper 25 at a position above its lower end connecting to said reservoir 15. Said damper 25 in accordance to its opening extent may adjust the fluid pressure against the inner periphery of said drum 11 and that inside said precipitating tube 14 and further adjusting the volume of fluid flowing into said tube 14 thereby enabling to prevent a reverse flowing of said fluid from the reservoir 15 to the drum 11 simultaneously working to promote the solids sedimentation.

The cyclone collector in the second embodiment is constituted as above, and is put in practical use as below.

Untreated water as it is injected into said drum 11 cyclonically moves therein resulting in the advance of solids of bigger gravity into said precipitating tube 14 through said opening 13 as in case of the first embodiment, said solids further moving into the reservoir 15 through said tube 14 and the lower terminal of said drum 11.

In the solids-liquid separating operation, said damper 25 may adjust the flowing volume inside said precipitating tube 14 so that pressure at the inside periphery of said drum 11 and that inside said tube 14 may become even and the solids under the effect of the centrifugal force may move within fluids of the same pressure thereby efficiently entering in the precipitating tube 14.

The solids-separated water is discharged out of said drum 11 through the cylindrical member 23 at its lower end opening and further through said passage 24 and exhaustion pipe 21. In this outflow of treated water, there is little possibility for untreated water to flow out as will be self-explanatory in the foregoing description, i.e., the water only at the center of its spiral movement may flow in said exhaustion pipe 21 which is positioned under the roof of said cylindrical member 23.

The outflow of the treated water centers around the spiral movement besides said cylindrical member 23 covering said releasing pipe 21 at its upper portion thereby preventing the direct outflow of said fluid or the fluid in the state of containing unseparated solids.

Figure 4:
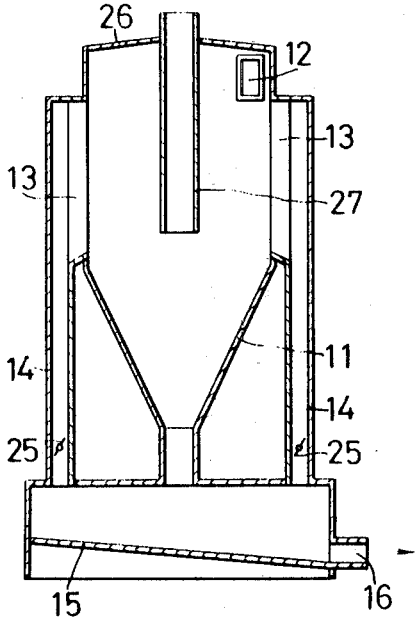
FIG. 4 is a longitudinal section of a cyclone collector in the third embodiment.

Reference will be made further to the third embodiment as shown in FIG. 4 wherein parts equivalent in constitution and function with those in the foregoing embodiments will be designated by same numerals also without repeating illustration thereof.

Shown in this embodiment is a cyclone collector suitable for separating solids from gases, wherein a precipitating tube 14 closed at its upper end incorporates a damper 25 simultaneously a cyclone collector drum 11 is provided at a position above an opening 13 with an injection pipe 12.

At the top wall 26 of the drum 11 closing the upper portion thereof is disposed an exhaling pipe 27 extending through the top wall 26, said pipe 27 at its lower end opening being located lower than the injection pipe 12 within the drum 11. This pipe 27 is disposed along the axis of the cyclone drum 11.

When solids-containing gas is injected into the drum 11, there may be separation of solids from said gas in the same process as that in the second embodiment shown in FIG. 3, the treated air being exhausted outside through the exhaling pipe 27.

As described hereinbefore, this invention is characterized in that one or more than one diametrically small precipitating tubes are mounted at the outer periphery of the cyclone collector drum in the state that said precipitating tubes each communicates with each opening of said drum, said opening being provided as many in number as said precipitating tube, thereby enabling the solids to be collected and precipitate within said tubes and as a result giving a big rise to the solid-fluid separating efficiency in this kind of devices.

Also the incorporation of a damper in the precipitating tube enables to adjust pressure within the drum and the tube and accordingly quicken the speed of fluid injection into the drum resulting in the generation of bigger centrifugal force thereby enabling to isolate solids from fluids with high efficiency, simultaneously the operation of damper preventing reverse flowing of the separated solids which may take place often otherwise.

What is claimed is:

1. A device for centrifugally separating solids from liquid or vapor, said device comprising:

a. a main body (11) having an upper cylindrical portion and funnel-shaped lower portion, said upper portion being open at its upper edge but being closed to the atmosphere by means for receiving said liquid or vapor as it flows over said upper edge, said lower portion being open at its lower end said receiver means including discharge means;

b. a container (15) closed to atmosphere, but said lower end in which separated solids are to be stored temporarily before being discharged;

c. a tangential injection inlet (12) in said main body upper portion, so disposed that solids-containing liquid or vapor fed through said tangential inlet follows a spiral path within said main body;

d. a plurality of outlets (13) from said main body, said outlets (13) being arranged in axial alignment at the outermost periphery of said main body; and, e. a plurality of vertical tubes (14) around the outermost periphery of said main body, each of said vertical tubes (14) having a vertical slit and each of said vertical tubes being positioned around the outermost periphery of said main body such that each of said tubes is open at both its upper and lower ends and each of said plurality of outlets from said main body opens to a respective one of said vertical slits, said tubes at their lower ends opening to said container (15), and at their upper ends opening to said receiving means.

* * * * *